US006279862B1

(12) United States Patent
Gershowitz

(10) Patent No.: US 6,279,862 B1
(45) Date of Patent: Aug. 28, 2001

(54) HANGER FOR SUSPENDING ARTICLES FROM WALLS

(76) Inventor: E. M. Gershowitz, 12417 Glen Carrie Rd., Ashland, VA (US) 23005

( * ) Notice: Subject to any disclaimer, the term of this patent is extended or adjusted under 35 U.S.C. 154(b) by 0 days.

(21) Appl. No.: 09/419,632

(22) Filed: Oct. 18, 1999

(51) Int. Cl.[7] ..... A47B 96/06; A47G 29/00; A47K 1/00; E04G 3/00; E04G 5/06

(52) U.S. Cl. ..... 248/216.1; 248/216.4; 248/218.1; 248/220.31; 248/489

(58) Field of Search ..... 248/216.1, 216.4, 248/218.1, 220.31, 475.1, 489, 479

(56) References Cited

U.S. PATENT DOCUMENTS 4,333,625 * 6/1982 Haug ..... 248/216.1
4,422,608 * 12/1983 Hogg ..... 248/205
4,509,713 * 4/1985 Hogg ..... 248/546
4,871,140 * 10/1989 Hoskinson et al. ..... 248/496
5,029,788 * 7/1991 Hoskinson et al. ..... 248/218.1
5,267,718 * 12/1993 Sheehan ..... 248/475.1
5,269,485 * 12/1993 Dwinell et al. ..... 248/216.4
5,673,803 * 10/1997 Burback ..... 211/87

* cited by examiner

*Primary Examiner*—Leslie A. Braun
*Assistant Examiner*—A. Joseph Wujciak
(74) *Attorney, Agent, or Firm*—Norman B. Rainer

(57) ABSTRACT

A hanger for a soft-core wall having an outer fabric covering includes a rigid panel having a flat rear surface, a number of sharp prongs downwardly emergent from the rear surface, and a hook member disposed forwardly of the front surface of the panel.

2 Claims, 1 Drawing Sheet

HANGER FOR SUSPENDING ARTICLES FROM WALLS

BACKGROUND OF THE INVENTION

1. Field of the Invention

This invention relates to hanger devices, and more particularly concerns a hanger for suspending an article from a soft-core fabric-covered wall.

2. Description of the Prior Art

Soft-core partition walls or panels are commonly used to subdivide open spaces in offices or to provide decorative effects or noise reduction. Such walls are typically covered with a textile fabric or other soft, flexible covering material. Their cores may be formed of a soft plaster, bonded low density fiberglass, cellulose, plasterboard, or other equivalent material. It is thus not recommended to use nails, tacks or conventional picture hangers with such partition panels, because the nails or tacks are likely to damage the core and/or the fabric. When a single nail is used to hang an article, substantially the entire weight of the article is concentrated at the point where the nail pierces the fabric, making it likely that the fabric will be torn, or that the core will be damaged, or both.

There are many items that an office worker might wish to fasten to the walls of his or her office cubicle. A large portion of these, such as small digital clocks, framed pictures, and the like, cannot readily be fastened to such walls without causing damage to the wall.

Specialized hangers have earlier been disclosed for use on soft-core office partition walls. For example, U.S. Pat. No. 5,269,485 to Dwinell et. al. discloses a soft-wall hanger having two downwardly directed sharpened spikes adapted to penetrate the fabric layer of the wall. U.S. Pat. No. 5,029,788 to Hoskinson et. al. discloses a soft-wall hanger having a single strand of stiff wire bent to form clip, hook and prong portions. The prong penetrates the fabric and hangs therefrom.

The hangers of the aforesaid patents utilize only the fabric component of the soft wall to support the hanger and utilize only one or two points of support. In time, the weight of the hanger and objects supported thereby cause stretching and/or tearing of the fabric.

It is accordingly an object of the present invention to provide a hanger device for use on a soft-core wall having an outer fabric covering.

It is another object of this invention to provide a hanger device as in the foregoing object which will not damage said fabric covering.

It is a further object of the present invention to provide a hanger device of the aforesaid nature which can be easily emplaced upon said soft-core wall and will provide stable support for relatively heavy objects.

It is a still further object of this invention to provide a hanger of the aforesaid nature of durable, simple construction amenable to low cost manufacture.

These objects and other objects and advantages of the invention will be apparent from the following description.

SUMMARY OF THE INVENTION

The above and other beneficial objects and advantages are accomplished in accordance with the present invention by a hanger for a soft-core wall having an outer fabric covering, said hanger comprising:

a) a rigid panel having a flat rear surface, opposed front surface and a perimeter edge having upper, lower and side portions, b) a number of sharp prongs downwardly emergent from said rear surface, and c) hook means extending forwardly of said front surface.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
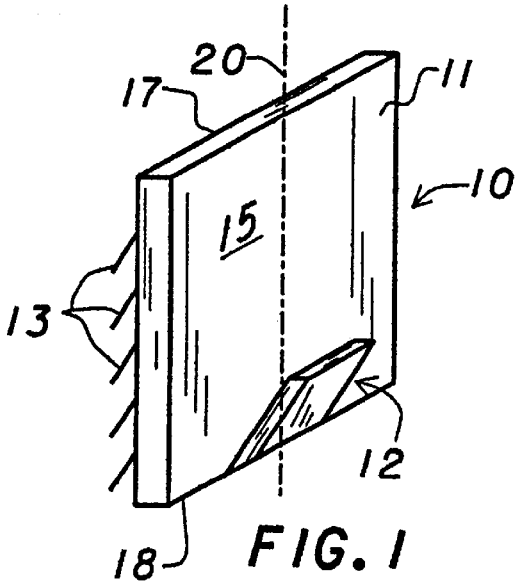
FIG. 1 is an enlarged front and side perspective view of an embodiment of the hanger of the present invention.
Figure 2:
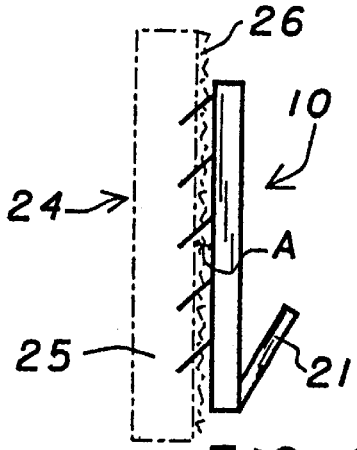
FIG. 2 is a side view of the embodiment of FIG. 1.
Figure 3:
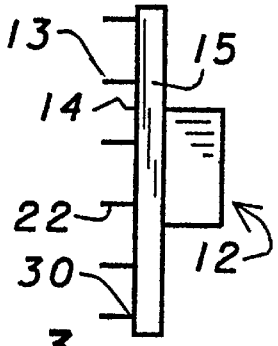
FIG. 3 is a top view.
Figure 4:
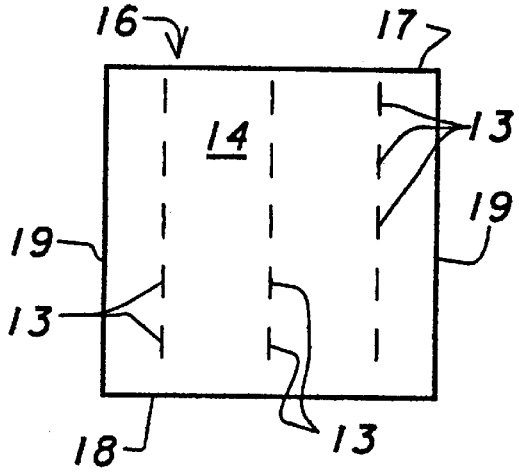
FIG. 4 is a rear view.

Referring now to FIGS. 1–6, an embodiment of the hanger 10 of the present invention is shown comprised of rigid panel 11, hook member 12 and a number of sharp prongs 13. Hanger 10 is shown in functional engagement with a soft-core wall 24, comprised of core 25 and outer fabric layer 26.

Panel 11 is bounded by a flat rear surface 14, opposed front surface 15 and a perimeter edge 16 exemplified as having a rectangular shape having upper and lower portions 17 and 18 respectively, and side portions 19. Said front surface is preferably flat, as illustrated. Panel 11 is preferably of plastic construction having a thickness, measured between said front and rear surfaces, of between 1/16" and 5/16". The width of the panel, measured between side portions 19 is preferably between 1 and 2 inches. The height of the panel, measured between said upper and lower edge portions, is between 1 and 2 inches. Although rear surface 14 is of substantially flat configuration, it may be provided with a roughened texture or a series of projections to enhance gripping of the fabric layer of the wall.

Hook means in the form of hook member 12 extends forwardly of said front surface, and is preferably a continuous integral extension of panel 11, having been formed by way of a molding operation that produces the panel. Alternatively, said hook member may be attached to panel 11 by way of adhesives or mechanical fasteners. The exemplified hook member 12 is pendant from lower portion 18 at the center vertical axis 20 of panel 11, and is comprised of an upwardly directed leg 21.

Figure 6:
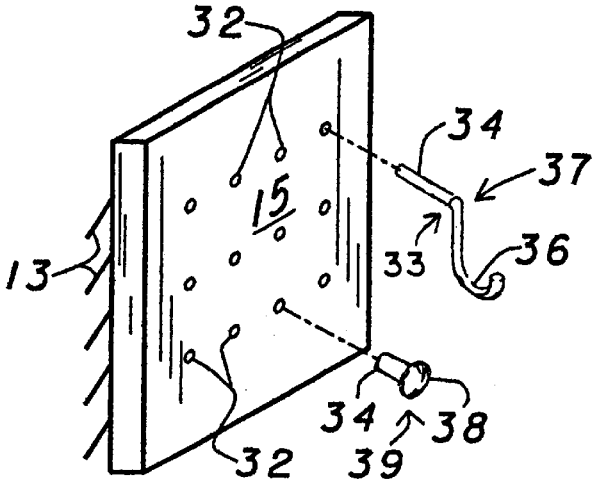
FIG. 6 is an enlarged front and side exploded perspective view of a second alternative embodiment of the hanger of this invention.
Figure 5:
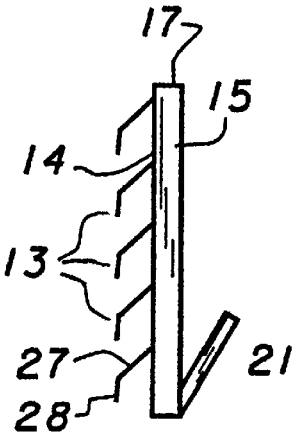
FIG. 5 is a side view of a first alternative embodiment.

In the second alternative embodiment of the hanger device of this invention, as illustrated in FIG. 6, said hook means is comprised of a series of holes 32 which open upon front surface 15, and at least one holder member 33 engageable by said holes. Said holder member has a straight shank portion 34 insertable into a hole 32, and a support portion which may be a hook-shaped extremity 36 of a bent wire 37 or the flanged head 38 of a conventional push pin or nail 39. The use of two or more holder members 33 may be employed, particularly when it is desired to maintain a horizontally level position of a picture equipped with a picture-hanging wire. Holes 32 are preferably disposed symmetrically with respect to axis 20.

Said prongs are fabricated of stiff metal wire of the nature employed in conventional push pins or tacks. Each prong extends between a pointed distal extremity 22 and a proximal extremity 30 which is embedded in said panel, said embedment preferably being achieved at the time of molding of said panel. The length of the prongs is between ⅛" and ¾", and all the prongs are preferably of equal length and of straight configuration. However, in the alternative embodiment shown in FIG. 5, the prongs are bent to produce proximal and distal legs 27 and 28, respectively.

The prongs are directed away from rear surface 14 at a downward penetration angle A of between 5 and 30 degrees. In the case of straight prongs, angle A is the angle at which the prong emerges from rear surface 14. In the case of bent prongs, said penetration angle A is the angle of intercept of the extension of distal leg 28 with said rear surface.

The prongs range in number from 4 to 20, and are preferably arranged in vertical columns and horizontal rows in symmetrical relationship to axis 20. It is preferable that least 4 prongs be present per square inch of said rear surface. The prongs are intended to enter the core of the panel. Because of the multiple sites of interengagement of the prongs with the fabric layer of the soft-core wall, the downward force exerted by objects held by the hanger is distributed over a relatively large region of the fabric and core, thereby avoiding any concentration of stress or force that would produce tearing or stretching of the fabric.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A hanger for a soft-core wall having an outer fabric covering over a soft core, said hanger comprising:

a) a rigid plastic panel having opposed flat front and rear surfaces and a perimeter edge having a vertical center axis, b) a number of prongs fabricated of stiff metal wire, each prong extending between a pointed distal extremity and a proximal extremity embedded in said panel and having a length between ⅛ inch and ¾ inch, said prongs numbering between 4 and 20 and directed away from said rear surface at a downward angle of between 5 and 30 degrees adapted to penetrate said soft core, and c) means for hanging an object, said hanging means comprised of at least one hole which opens upon said front surface, and at least one holder member engageable by said hole, said holder member having a straight shank portion insertable into said hole.

2. The hanger of claim 1 wherein said prongs are arranged in symmetrical relationship to said axis.

* * * * *